US007441389B2

(12) United States Patent
Scholtis et al.

(10) Patent No.: US 7,441,389 B2
(45) Date of Patent: Oct. 28, 2008

(54) DEVICE FOR VACUUM PACKING ARTICLES, STORAGE CONTAINER FOR SUCH A DEVICE AND VACUUM PACKING SYSTEM

(76) Inventors: Thomas Scholtis, Am Kamp 13, 26345 Grabstede (DE); Thomas Turkovic, Zwischen den Wegen 26, 78239 Rielasingen-Worblingen (DE)

( * ) Notice: Subject to any disclaimer, the term of this patent is extended or adjusted under 35 U.S.C. 154(b) by 356 days.

(21) Appl. No.: 11/341,816

(22) Filed: Jan. 27, 2006

(65) Prior Publication Data

US 2006/0177158 A1 Aug. 10, 2006

(30) Foreign Application Priority Data

Jan. 28, 2005 (DE) ..... 10 2005 004 247
Jan. 28, 2005 (DE) ..... 20 2005 001 464 U
May 19, 2005 (DE) ..... 20 2005 008 091 U

(51) Int. Cl.
*B65B 31/20* (2006.01)
*B65D 31/04* (2006.01)

(52) U.S. Cl. ..... 53/512; 53/79; 99/472

(58) Field of Classification Search ..... 53/79, 53/88, 84, 111 R, 510, 512; 206/524.8; 99/454, 472

See application file for complete search history.

(56) References Cited

U.S. PATENT DOCUMENTS 2,116,813 A * 5/1938 O'N Weisser et al. ..... 99/472
3,648,470 A * 3/1972 Pruitt ..... 141/8
3,722,558 A * 3/1973 Worline ..... 141/65
3,893,649 A * 7/1975 Cornell et al. ..... 248/99
3,939,287 A 2/1976 Orwig et al.
3,943,987 A * 3/1976 Rossi ..... 206/524.8
3,980,226 A * 9/1976 Franz ..... 383/71
5,121,590 A * 6/1992 Scanlan ..... 53/510
5,195,427 A * 3/1993 Germano ..... 99/472
5,228,271 A 7/1993 Wallace et al.
5,263,520 A 11/1993 Arai
5,299,917 A 4/1994 Schultz
5,333,736 A 8/1994 Kawamura
5,398,811 A * 3/1995 Latella, Jr. ..... 206/524.8
5,494,165 A * 2/1996 Detrick ..... 206/524.8
5,661,873 A 9/1997 Karet
6,059,457 A 5/2000 Sphrehe et al.
6,085,906 A * 7/2000 Lambert ..... 206/524.8
6,623,413 B1 * 9/2003 Wynne ..... 493/101
6,763,857 B2 * 7/2004 Brown ..... 141/65
6,799,506 B2 * 10/2004 Tarlow ..... 99/472
7,086,211 B2 * 8/2006 Bassett et al. ..... 53/434
7,197,860 B2 * 4/2007 Hughes et al. ..... 53/510

(Continued)

FOREIGN PATENT DOCUMENTS

DE 72 117 11/1892

(Continued)

*Primary Examiner*—Paul R Durand
(74) *Attorney, Agent, or Firm*—McGlew & Tuttle, P.C.

(57) ABSTRACT

In a device for vacuum packing articles by evacuating the interior space of a flexible storage container, articles can be vacuum packed in a simple manner and with little effort if a suction lance (10) is provided for insertion into the storage container (28), by means of which the interior space of the storage container (28) is evacuated. A filtering section is provided (20, 21) for retaining particles, fluid and/or other contaminants.

21 Claims, 8 Drawing Sheets

U.S. PATENT DOCUMENTS

| | | | | |
|---|---|---|---|---|
| 7,272,919 | B2 * | 9/2007 | Cheung | 53/510 |
| 7,308,785 | B2 * | 12/2007 | Bassett et al. | 53/512 |
| 7,331,163 | B2 * | 2/2008 | Hau et al. | 53/512 |
| 2003/0015452 | A1 | 1/2003 | Su | |
| 2003/0178066 | A1 | 9/2003 | Skeen et al. | |
| 2004/0112458 | A1 | 6/2004 | Brown | |
| 2004/0131731 | A1 | 7/2004 | Sprehe et al. | |

FOREIGN PATENT DOCUMENTS

| | | | |
|---|---|---|---|
| DE | 1 961 619 | | 6/1971 |
| DE | 2828770 | A1 | 1/1980 |
| DE | 195 41 975 | | 5/1997 |
| DE | EP1053945 | | 12/1997 |
| FR | 620 292 | | 4/1927 |
| IT | EP0811556 | | 11/2000 |
| WO | WO 01/177861 | | 3/2001 |

* cited by examiner

DEVICE FOR VACUUM PACKING ARTICLES, STORAGE CONTAINER FOR SUCH A DEVICE AND VACUUM PACKING SYSTEM

CROSS REFERENCE TO RELATED APPLICATIONS

This application claims the benefit of priority under 35 U.S.C. § 119 of DE 10 2005 004 247.3 filed Jan. 28, 2005 and DE 20 2005 001 464.8 filed Jan. 28, 2005 and DE 20 2005 008 091.8 filed May 19, 2005 the entire contents of each is incorporated herein by reference.

FIELD OF THE INVENTION

The present invention pertains to a device for vacuum packing articles by evacuating the interior space of a flexible storage container. Moreover, the present invention pertains to a storage container for such a device as well as a vacuum packing system.

BACKGROUND OF THE INVENTION

In the area of foodstuffs, foods are frequently vacuum-sealed in a bag after evacuating. As a result of this, a low volume is obtained with good protection of the food at the same time. In particular, an annoyance caused by a bad smell is also prevented in case of longer storage. The drawback in this case is that considerable hygienic problems may result due to contaminants. Problems may result due to such contaminants above all in outdoor types of sports, for example, fishing.

However, garbage, especially residual waste, is also frequently calculated by volume in the case of removal. Moreover, particularly with longer removal intervals, undesired annoyances caused by a bad smell occur because of the garbage. Therefore, devices for reducing the garbage volume, in which the garbage is compressed by evacuating the storage container, have already been suggested.

The drawback in this case is that, on the one hand, the storage containers have a complicated and thus expensive design in order to be suitable for evacuation and subsequent transport under vacuum. Another problem arises especially if the garbage to be compressed has fine particles, fluids and in particular contaminants causing bad smells.

SUMMARY OF THE INVENTION

The basic object of the present invention is to provide a device, with which articles can be vacuum packed in a simple manner and with little effort, without there being a risk that particles, fluids and/or contaminants causing bad smells reach the open air.

The object is accomplished in that with a device of the type mentioned in the introduction, a suction lance, by means of which the interior space of the storage container is evacuated, is provided for inserting into the storage container, and which contains filtering means for retaining particles, fluids and/or other contaminants.

By providing this suction lance, the requirements on the storage container are considerably reduced, such that practically any conventional bag, provided it has sufficient strength, can be used for vacuum packing articles. In principle, it is sufficient to insert the suction lance into the opening of the bag and remove the excess air from this bag by evacuation. The undesired escape of particles, fluids and/or other contaminants, in particular those which cause bad smells, is reliably prevented by means of the filtering means in the suction lance. In this way, it is possible, moreover, to connect the suction lance for evacuating to the suction hose of a vacuum cleaner or any hand pump.

In a variant of the present invention, the suction lance has an elongated insertion connection piece with stepped orifice. This elongated insertion connection piece can be inserted deep into a storage container, whereby the stepped orifice prevents clogging of the orifice opening to a large extent. Moreover, the orifice may have radial slots, which continue preferably up to the outer peripheral area of the orifice. This reliably counteracts clogging of the opening during the suctioning out of the air located in the storage container.

Another variant of the present invention is characterized in that the suction lance has a filter chamber for accommodating the filter/filtering means with a storage section for particles and fluids and a reaction section arranged downstream of the storage section. The storage section may have a foam filter and the reaction section may have an activated carbon filter. In this way, it is guaranteed that particles and fluids are reliably retained by the foam filter, while contaminants, which pass through this foam filter and cause bad smells, are retained by the activated carbon filter.

In another embodiment, a one-way valve is provided for preventing the backflow of gases into the storage container. This one-way valve prevents a back flow of air into the storage container after the evacuation of the storage container, such that after removing the suction lance from the storage container, this storage container can be sealed in the evacuated state. Preferably, the one-way valve is arranged between the storage section and the reaction section.

In another embodiment a mount, designed as a cone-shaped, expanding tube section, is provided for the evacuating means. This mount is used, for example, for accommodating a vacuum cleaner or a vacuum cleaner hose. Since the mount is designed as a cone-shaped, expanding pipe section, vacuum cleaners or vacuum cleaner hoses of different diameters can be accommodated. A suitable hand pump may also be connected.

Moreover, the suction lance may have an elongated outlet. The outlet may be arranged in the area of the mount. If the outlet has radial slots, which preferably extend over the outer peripheral area of same, a large discharge opening is available for gas flowing through the outlet.

Particularly in the application of the device according to the present invention in the area of food, a fluid trap is expedient. If, for example, foods that contain large amounts of fluid are to be packed, this fluid can be taken up by the fluid trap, whereupon contamination of the rest of the device is prevented. Preferably, the fluid trap shall be detachable. Thus, on the one hand, a simple cleaning possibility is given. On the other hand, the fluid trap may also be embodied as a disposable product.

According to another aspect of the present invention, a storage container is provided with a sealable opening for inserting articles and an evacuating connection, which is embodied as a hose connection piece. This storage container advantageously cooperates with the suction lance. The insertion connection piece of the suction lance is inserted into the hose connection piece of the storage container. After evacuating the storage container, the insertion connection piece is then removed again from the hose connection piece, whereby the walls of the hose connection piece are joined to one another by means of the vacuum generated in such a way that the storage container is already almost sealed. In this state, the hose connection piece can then be sealed simply by means of tying.

The storage container may preferably be embodied as a returnable storage container. In a preferred embodiment, the storage container consists of a laminated double-layer film. An inner layer may consist of polyethylene (PE) and an outer layer may consist of polyamide (PA). Polyethylene (PE) is favorable in production and food-safe. Polyamide (PA) is tear-resistant and airtight.

Moreover, it is advantageous if the hose connection piece has a plurality of ribs. These ribs may be formed with one another, for example, simply by welding a partial area of the walls of the hose connection piece. These ribs provide for a stiffening and for a simple insertion of the insertion connection piece into the hose connection piece. At the same time, clogging of the orifice area of the insertion connection piece is counteracted.

In another exemplary embodiment, the hose connection piece and/or the opening of the storage container can be sealed by means of a clip seal, a pressure seal or a zipper seal. In this way, the storage container can be sealed in a simple manner and tightly. The clip seal, pressure seal or zipper seal may be laminated or welded to the storage container or the hose connection piece. In this way, the storage container can be produced in a single lamination process or welding process.

Another embodiment of the storage container is characterized in that the interior space of the storage container has a plurality of chambers. These chambers may be used for accommodating different articles. For example, separate chambers may be provided for vegetables, meat, starch side dish, gravy as well as dessert. In this way, the respective contents, separated from one another, can be packed in the different chambers in a tasty and yet reliable manner. Preferably, the chambers are in fluid connection with one another and with the hose connection piece, in order to thus be able to evacuate all chambers evenly. Another advantageous embodiment is characterized in that keep-clear means are provided for the fluid connection. In this way, a tightening of the fluid connection during the evacuation is prevented.

Moreover, it is advantageous if the storage container is made of a synthetic resin material suitable for microwave radiation. In this way, the storage container with the foods contained therein can be placed, for example, completely into the microwave for heating up.

According to another aspect of the present invention, a vacuum packing system with a device and a storage container having the features of the present invention is provided. Such a vacuum packing system can be used in many different ways and in a flexible manner.

An exemplary embodiment of the present invention is explained in detail below based on the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
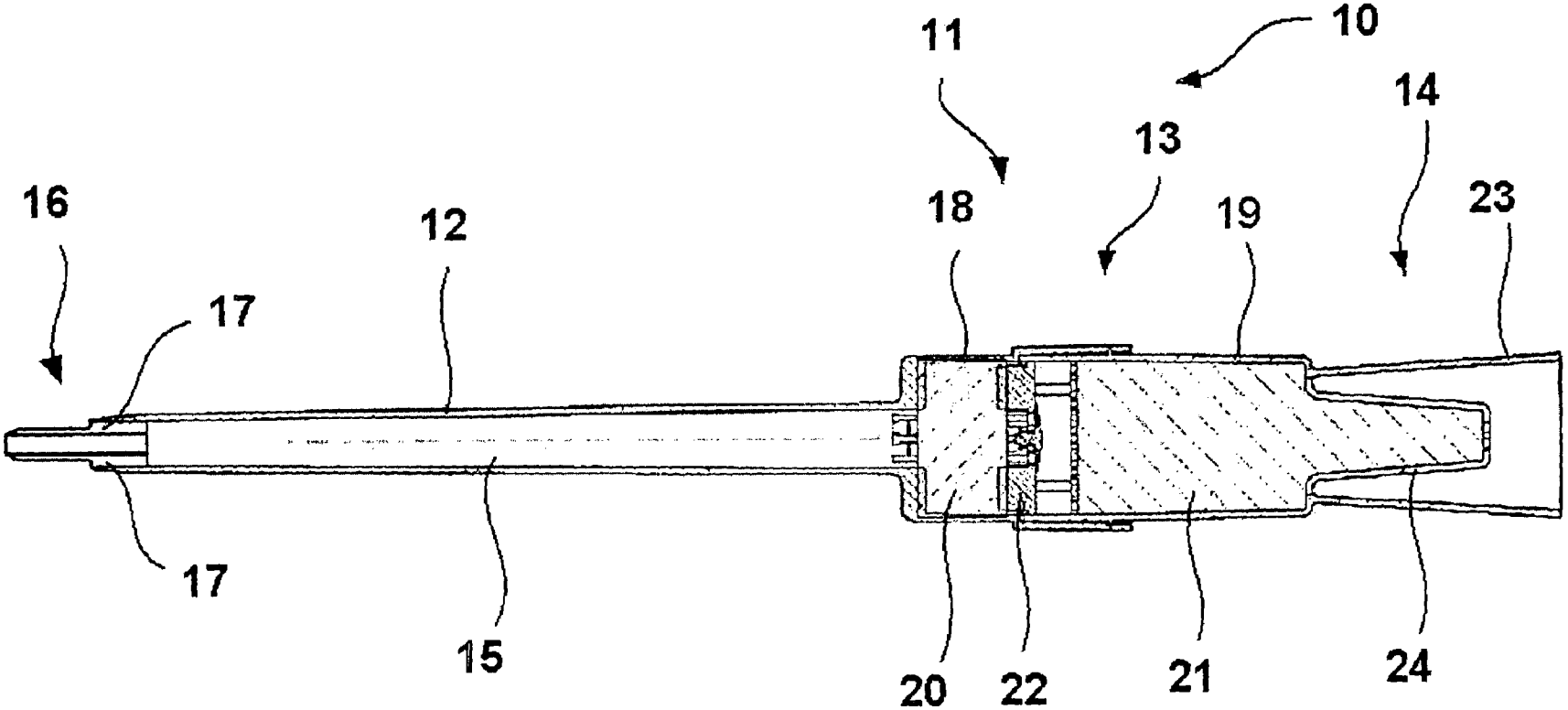
FIG. 1 is a schematic sectional view of a suction lance with the features of the present invention.

Referring to the drawings in particular, FIG. 1 shows a schematic sectional view of a suction lance 10 with the features of the present invention. The suction lance 10 has a housing 11 with an insertion connection piece 12, a filter chamber 13 and a mount (suction/vacuum mount) 14. The insertion connection piece 12 has an elongated, cylindrical shape and forms, in the interior, a channel 15, which is connected with the filter chamber 13 and with an orifice 16 on the end facing away from same. The orifice has a stepped design, so that the insertion connection piece 12 has an at least twofold external diameter in the orifice area. Slots 17, which extend radially and run up to in the outer peripheral area of the orifice 16, are provided in the area of the orifice 16. The slots 17 are in fluid connection with the channel 15.

The filter chamber 13 has a first housing part 18 and a second housing part 19, which can be connected with one another by means of a bayonet catch or a threaded section. The first housing part 18 forms a storage section, in which is arranged a foam filter 20. Analogously thereto, the second housing part 19 forms a reaction section, in which is arranged an activated carbon filter 21. In the mounted state, as shown in FIG. 1, a one-way valve 22, which separates the storage section from the reaction section, is arranged between the foam filter 20 and the activated carbon filter 21.

As can be further inferred from the figure, the mount has a cone-shaped tube section 23, expanding toward its end facing away from the second housing part 19. An outlet 24 is arranged in the interior of the tube section 23. The outlet 24 has an elongated shape.

Figure 2:
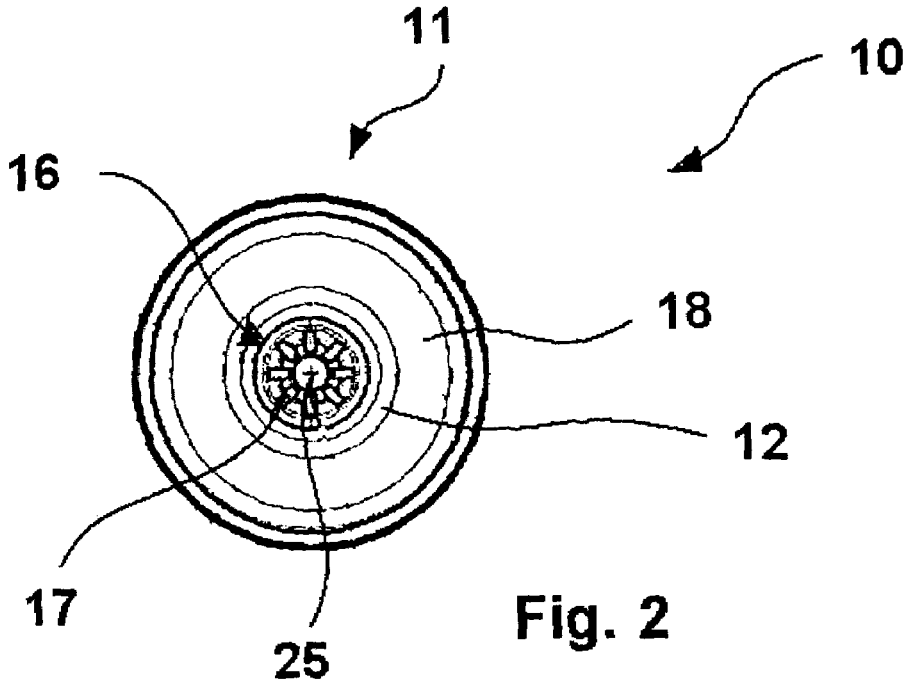
FIG. 2 is a front view of the suction lance of FIG. 1.

FIG. 2 shows a front view of the suction lance 10, viewed from the left in FIG. 1. As can be inferred from the figure, a plurality of radially running slots 17, which surround an opening 25 arranged on the front side in the orifice, are arranged in the area of the orifice 16.

Figure 3:
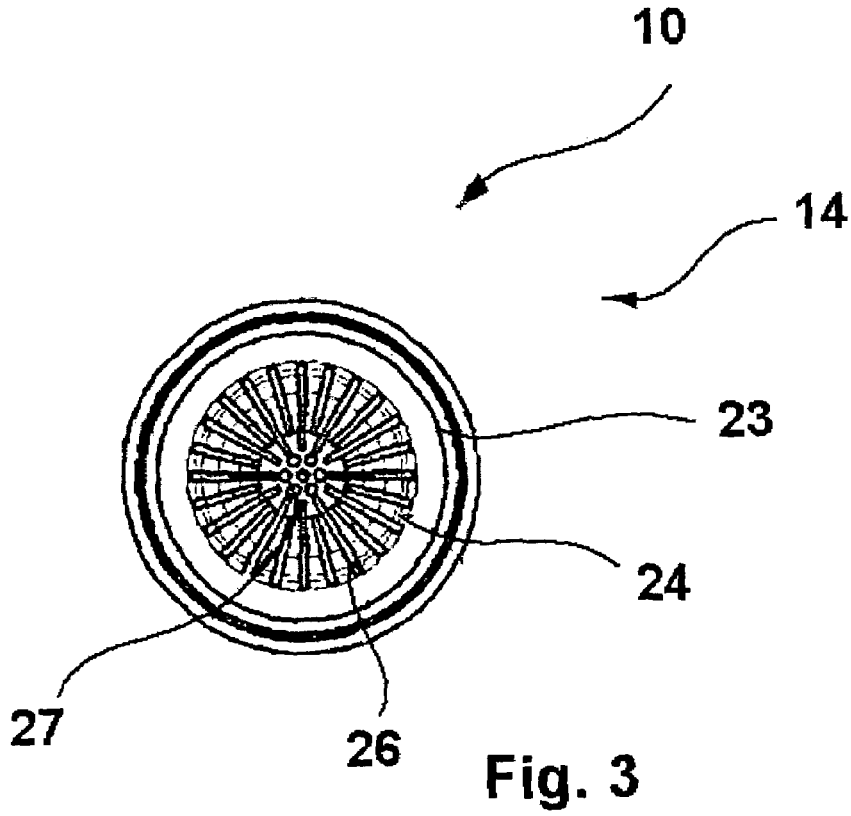
FIG. 3 is a rear view of the suction lance.

FIG. 3 shows a rear view of the suction lance 10, viewed from the right in FIG. 1. A plurality of radial slots 26 in the area of the outlet 24 can be clearly seen in the figure. The front surface of the outlet 24 is in turn perforated by a plurality of circular openings 27.

Figure 4:
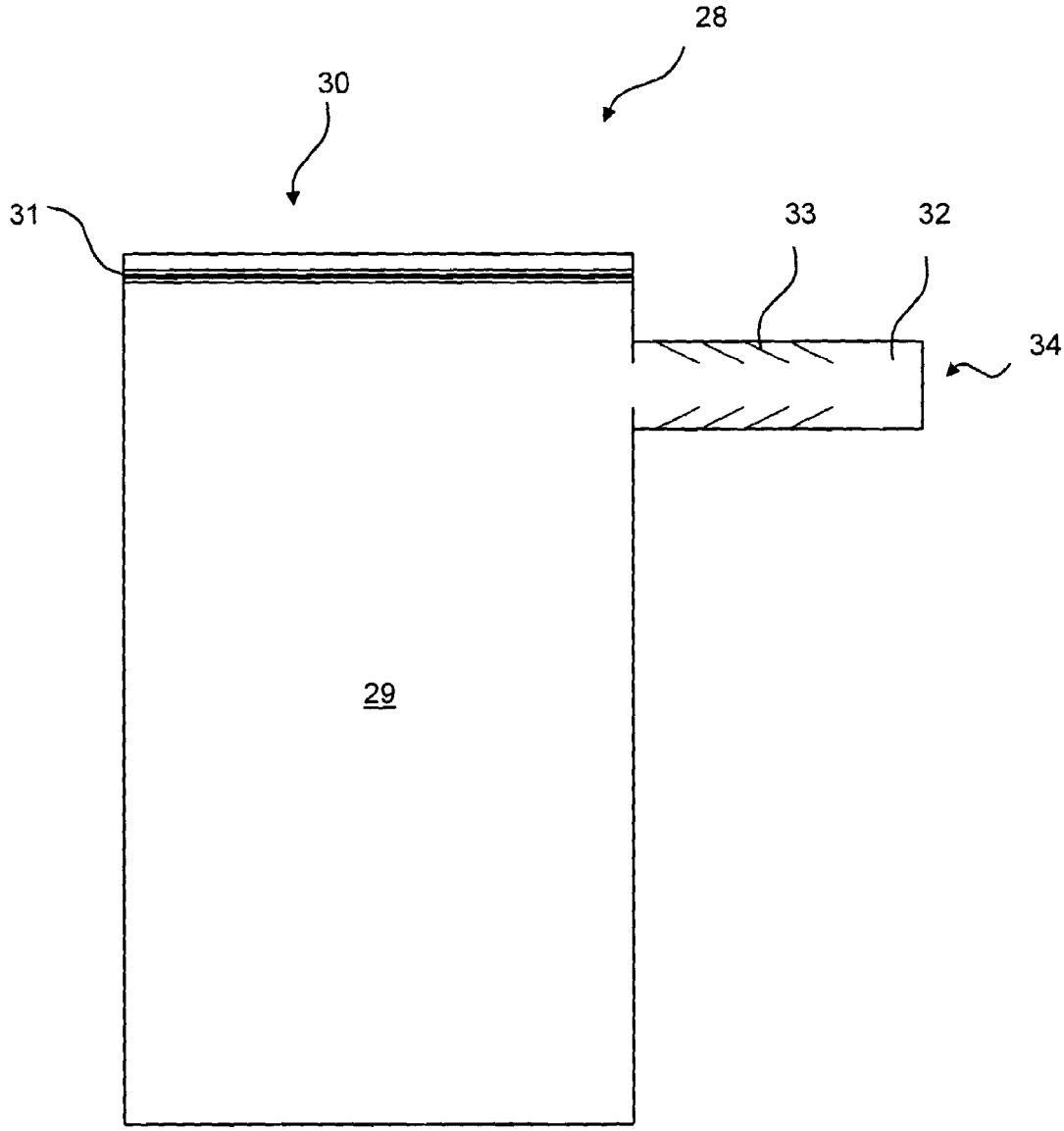
FIG. 4 is a schematic view of a storage container for the suction lance.

FIG. 4 shows a schematic view of a storage container 28 for cooperating with the suction lance 10. The storage container 28 shown is a garbage bag with a mount section 29, in the figure a bag 29. The bag 29 has an opening 30, which, in the exemplary embodiment shown, can be sealed in a vacuum-tight manner by means of a clip seal (male female engaging parts or zipper seal) 31. Furthermore, the bag 29 is connected with a hose connection piece 32, which has a plurality of ribs 33 and is further provided with an opening 34 at the end facing away from the bag 29. The ribs 33 are formed by welding an edge area of the hose connection piece 32.

The mode of operation and the cooperation of the suction lance 10 with the storage container 28 are explained below in detail based on FIGS. 1 through 4:

At first, garbage is collected in the bag 29. For this, the opening 30 is in an opened state, so that the garbage can be inserted through the opening 30 into the bag 29. If the expected quantity of garbage is present in the bag 29, the opening 30 is sealed by means of the clip seal 31. The suction lance 10 with its insertion connection piece 12 is then inserted into the opening 34 of the hose connection piece 32. The ribs 33 facilitate insertion of the orifice 16. Next, a vacuum cleaner with its vacuum cleaner hose is plugged into the mount 14. For this, the front end of the vacuum cleaner hose (evacuation suction/vacuum source) is pushed into the tube section 23. Due to the cone-shaped, expanding inner cross section of the tube section 23 the external diameter of the vacuum cleaner hose does not have to be exactly coordinated to the tube section 23. After switching on the vacuum cleaner, the air from the bag 29 reaches the channel 15 through the hose connection piece 32 and the orifice 16. Due to the stepped design of the orifice 16 as well as the slots 17 running out over the outer peripheral area of the orifice 16, the bag 29 or the hose connection piece 32 is prevented from being attached in the orifice area 16 in such a way that the orifice area 16 is sealed. The ribs 33 support the remaining open of the slots 17. The air reaches the first housing part 18 from the channel 15. Particles or liquid components which are possibly also suctioned from the bag 29 are reliably retained by the foam filter 20. The gaseous components passing through the foam filter 20 then pass through the activated carbon filter 21. Any contaminants causing bad smells are retained by the activated carbon filter 21. The outgoing air from the bag 29 purified in this manner then passes through the slots 26 and the openings 27 from the outlet 24 into the tube section 23 and is suctioned there by the vacuum cleaner. After switching off the vacuum cleaner, the air can not flow back into the bag 29 again, since a backflow is reliably prevented by means of the one-way valve 22. The insertion connection piece 12 is removed from the hose connection piece 32, whereby the wall areas of the hose connection piece 32 are drawn together by means of the vacuum prevailing in the bag 29 in such a way that the hose connection piece 32 is sealed in a vacuum-tight manner. The hose connection piece 32 can then be lastingly rigidly sealed by means of simple tying.

Figure 5:
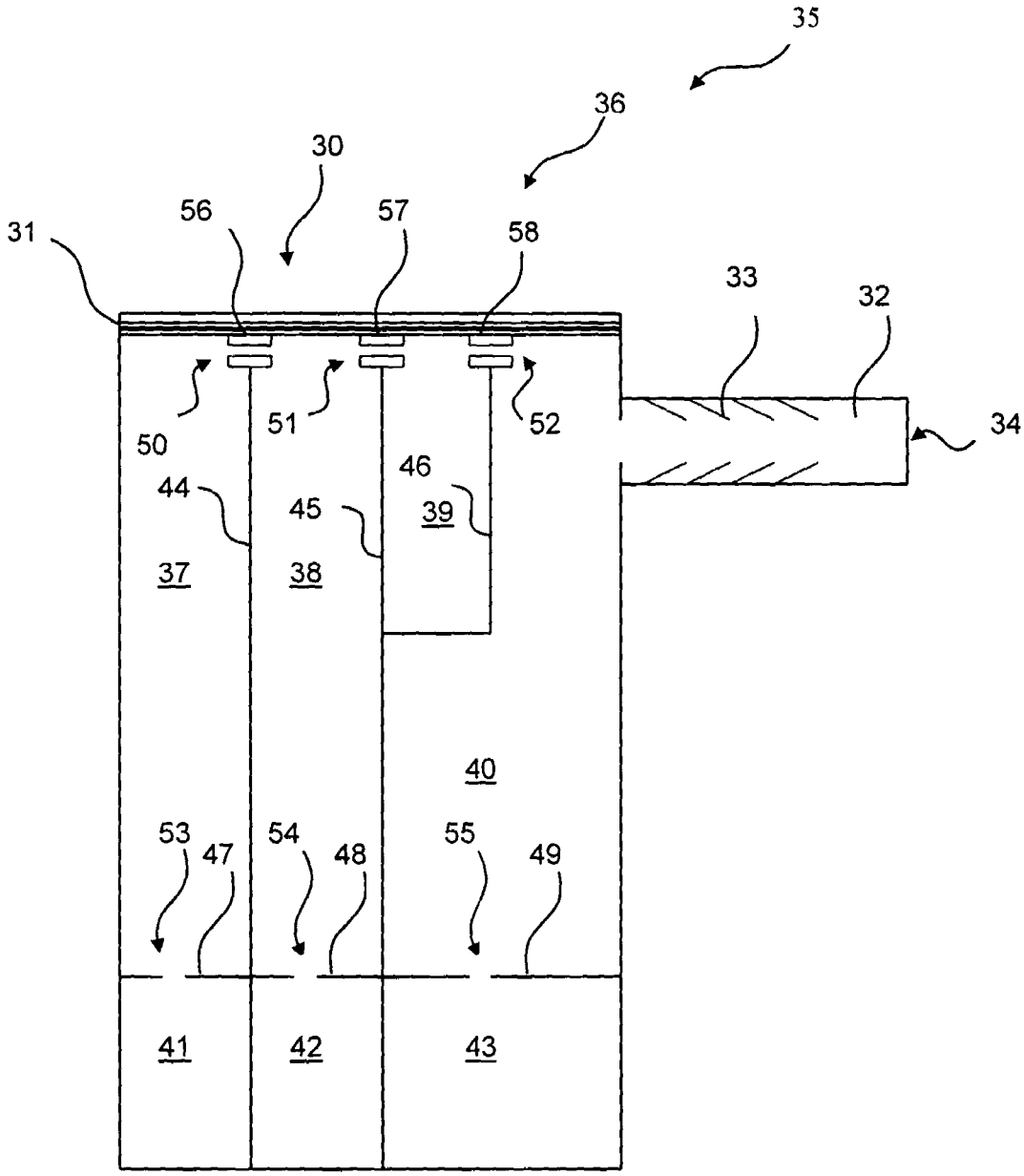
FIG. 5 is a schematic view of a storage container according to a second exemplary embodiment.

FIG. 5 shows a second exemplary embodiment of a storage container 35 with the features of the present invention. The storage container 35 essentially corresponds to the storage container 28. Identical elements have the same reference numbers. Unlike the storage container 28, the storage container 35 has a bag 36 with a plurality of chambers 37 through 43. The chambers 37 through 43 are separated from one another by means of webs 44 through 49. The webs 44 through 49 are, for example, embodied as weld seams in the bag 36. An opening 50 through 55 each is located in the respective webs 44 through 49 between adjacent chambers. Moreover, spacers 56, 57, 58, by means of which clogging of the openings 50, 51, 52 during the evacuation of the bag 36 is prevented, are provided for the openings 50, 51 and 52.

The desired foods are inserted separately into the respective chambers 37 through 43 in the storage container 35. For example, sauces or desserts, which are injected into the respective chamber 41 through 43 by means of an elongated channel through the openings 53 through 55, may be located in the chambers 41 through 43. For example, meat, side dishes, vegetables and starch side dishes may each be inserted separately into the chambers 37 through 40. The opening 30 is then sealed by means of the clip seal 31. The respective dishes in the chambers 37 through 43 are separated from one another in this state by means of the webs 44 through 49. By means of plugging the insertion connection piece 12 into the hose connection piece 32, the air remaining in the bag 36 can then be suctioned out by means of the suction lance 10. At first, the air is removed from the chamber 44, into which the air can again flow through the openings 52 and 55 from the chambers 39 and 42. Likewise, the air from the chambers 37, 38, 39, 41, 42 can likewise reach the chamber 40 through the openings 50, 51, 52, 53, 54 and be suctioned out there by means of the suction lance 10. The spacers 56, 57, 58, which may be thickened areas in the synthetic resin material of the bag 36, prevent clogging of the openings 50, 51, 53 by tightening the bag 36.

Figure 6:
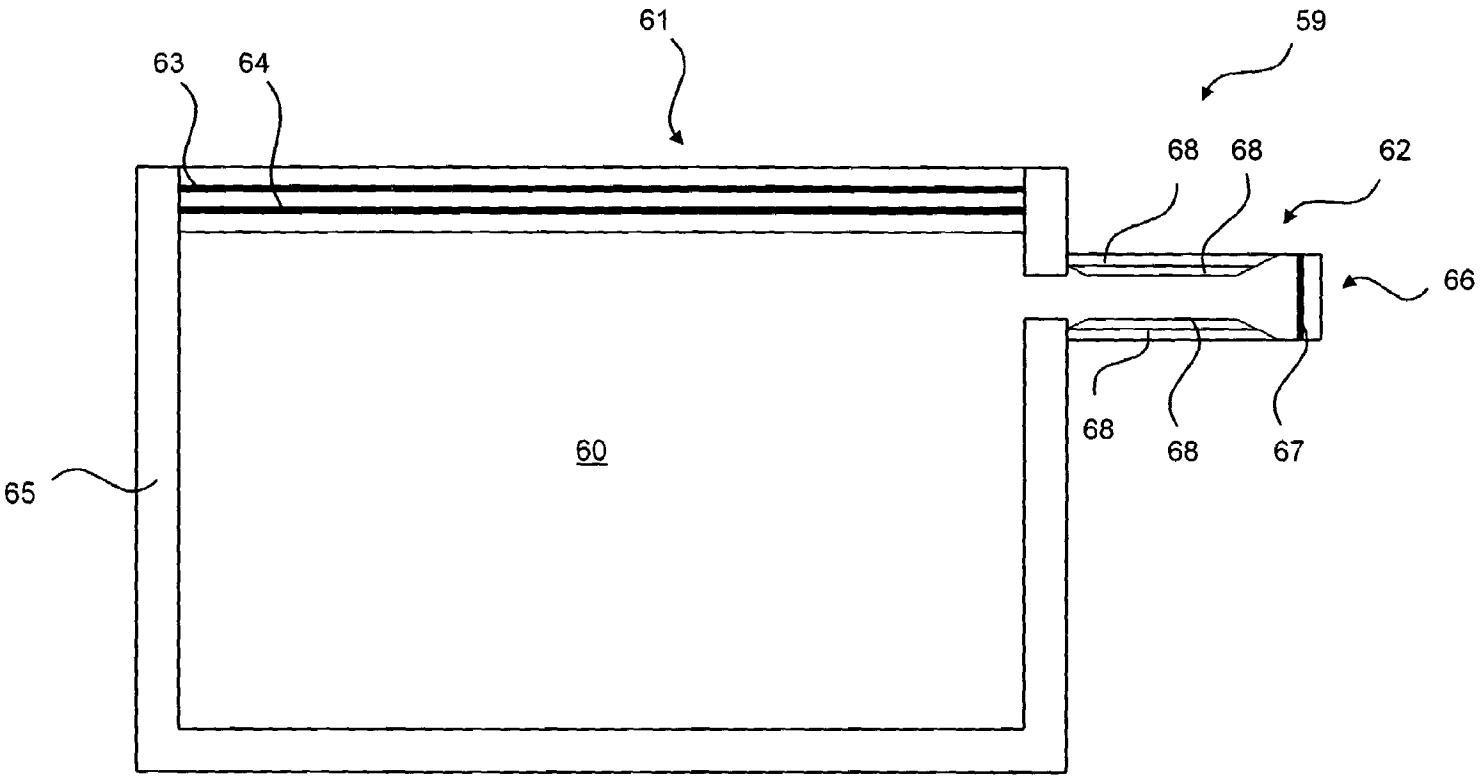
FIG. 6 is a schematic view of a storage container according to a third exemplary embodiment.

FIG. 6 shows a third exemplary embodiment of a storage container 59 with the features of the present invention. The storage container 59 essentially corresponds to the storage containers 28 and 35 described above. The storage container 59 likewise has a bag 60 with an opening 61 and a hose connection piece 62. In the exemplary embodiment shown, the storage container 59 is designed as a returnable storage container and consists of a laminated double-layer film. In particular, an inner layer of the storage container 59 is made of polyethylene (PE), which is food-safe, on the one hand, and, on the other hand, can be produced and processed at a reasonable cost. An outer layer of the storage container 59 consists of polyamide (PA), which is tear-resistant, on the one hand, and, on the other hand, guarantees the required airtightness.

In the exemplary embodiment shown, the opening 61 can be sealed airtightly by means of a clip seal 63, 64 having a dual design. A weld seam, which connects the two halves of the bag with one another, is arranged surrounding the bag.

The hose connection piece 62 has an opening 66, to which a clip seal 67 is assigned. Furthermore, weld seams 68 corresponding to the ribs 33 are provided adjacent to the longitudinal edges of the hose connection piece 62. After evacuating the bag 60, the opening 66 is sealed airtightly by means of the clip seal 67.

The mode of operation of the storage container 59 corresponds to that of the storage containers 28 and 35. In the embodiment shown, the clip seals 63, 64, 67 and the weld seams 65, 68 can be produced during the lamination, such that the storage container 59 can be manufactured in a single operation.

Figure 7:
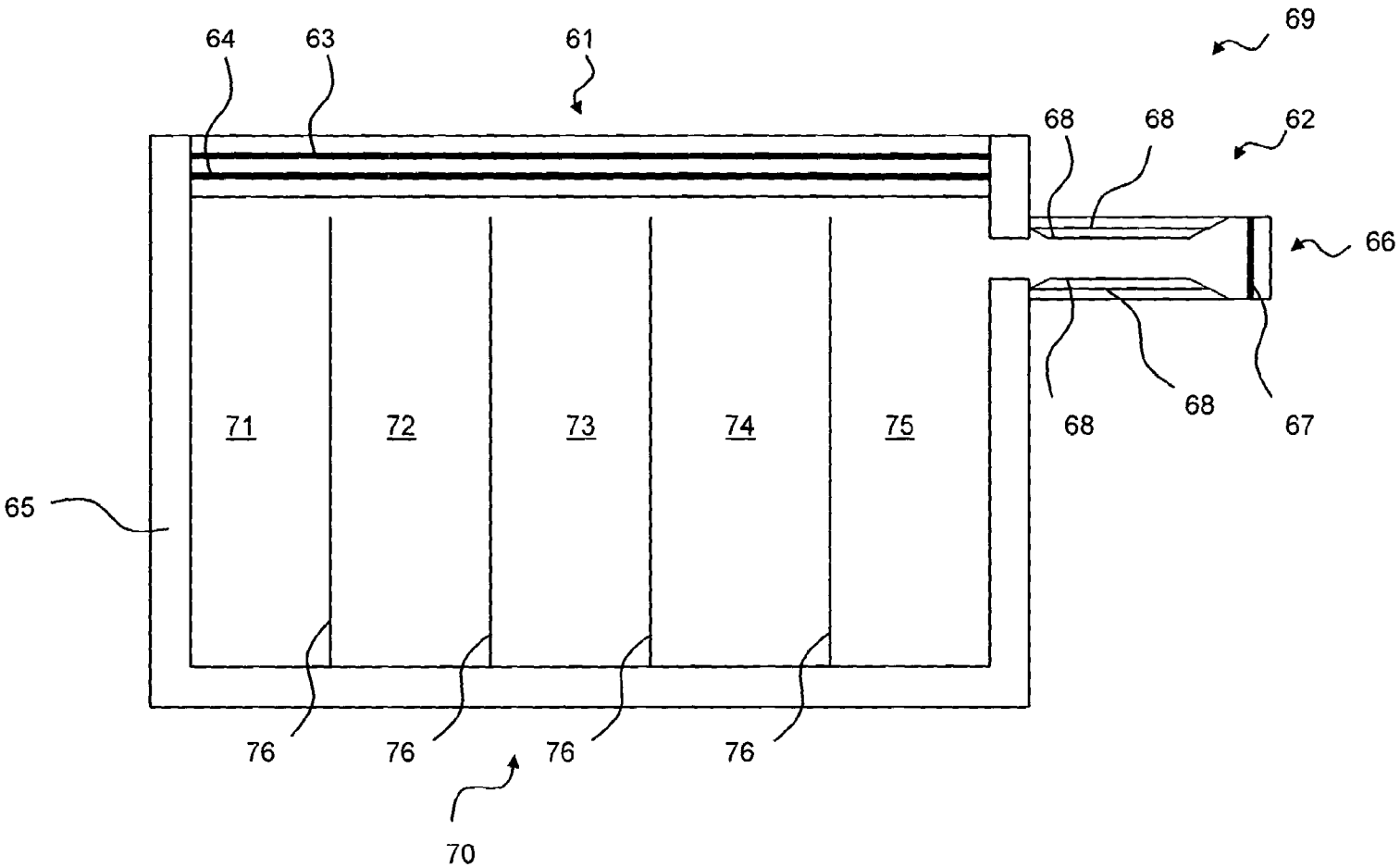
FIG. 7 is a schematic view of a storage container according to a fourth exemplary embodiment.

FIG. 7 shows a fourth exemplary embodiment of a storage container 69 with the features of the present invention. The storage container 69 essentially corresponds to the storage container 59 and likewise consists of a laminated double-layer film. Identical elements have the same reference numbers. In contrast to the storage container 59, the storage container 69 has a bag 70, whose interior space is divided into a plurality of chambers 71 through 75 by means of webs 76. In the exemplary embodiment shown, the webs 76 are embodied as weld seams and terminate in the lower area of the weld seam 65. The webs 76 run parallel to one another in the upwards direction and end a short distance from the clip seals 63, 64, such that the chambers 71 through 75 in the upper area of the webs 76 are in fluid connection with one another. In this way, the chambers 71 through 75 can be evacuated together during the evacuation of the bag 70 just like the chambers 37 through 43 of the storage container 35.

Figure 8:
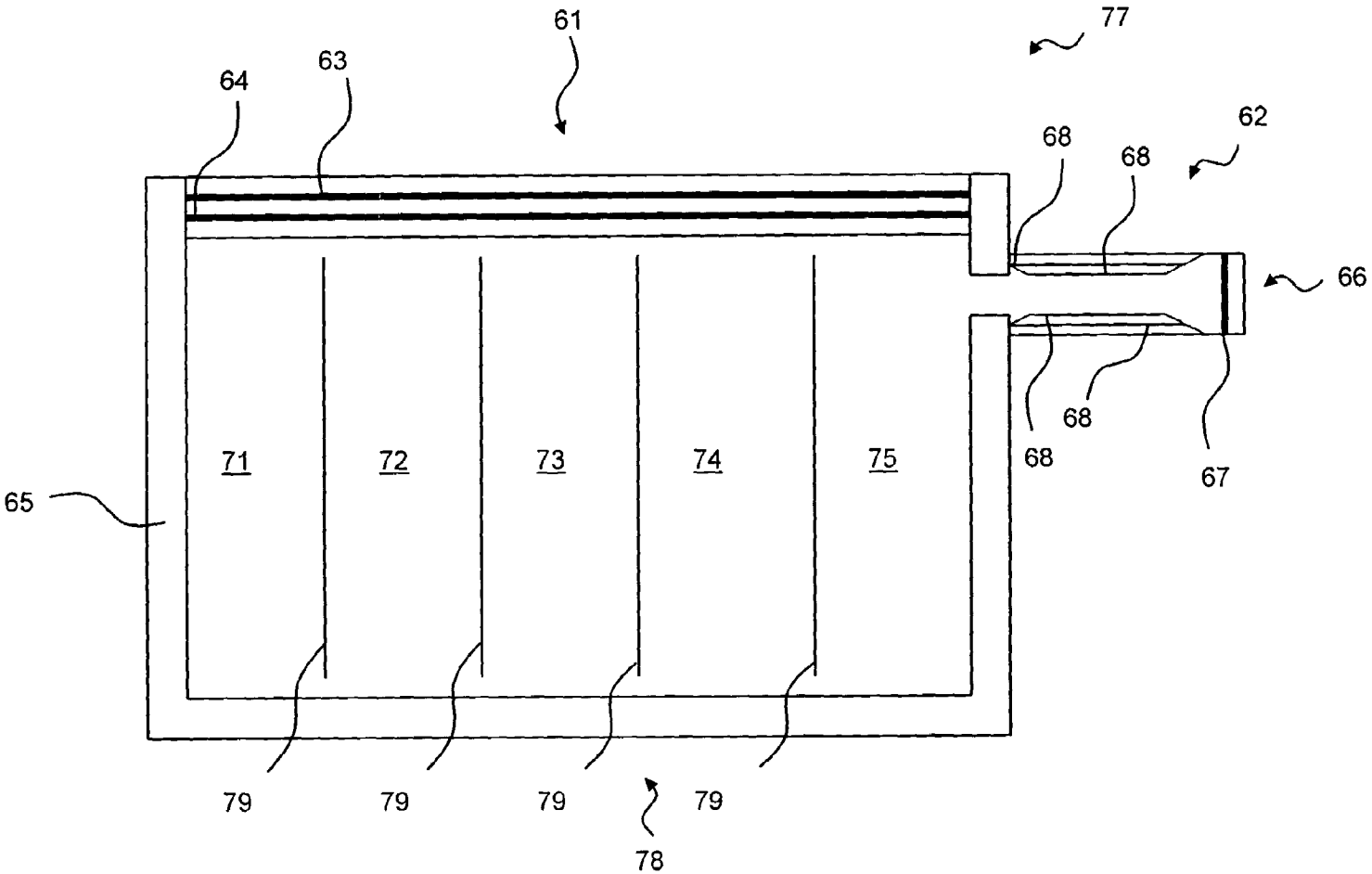
FIG. 8 is a schematic view of a storage container according to another exemplary embodiment.

FIG. 8 shows another exemplary embodiment of a storage container 77 with the features of the present invention. The storage container 77 essentially corresponds to the storage container 69. Identical elements have the same reference numbers. In contrast to the storage container 69, the storage container 77 has a bag 78, whose chambers 71 through 75 are separated from one another by means of webs 79. Unlike the webs 76, the webs 79 end in the lower area at a distance from the weld seam 65, such that the chambers 71 through 75 are in fluid connection with one another both in the upper and in the lower area of the webs 79. With larger articles in the chambers 71 through 75, for example, caught fish, this facilitates the evacuation of the chambers 71 through 75 together.

Figure 9:
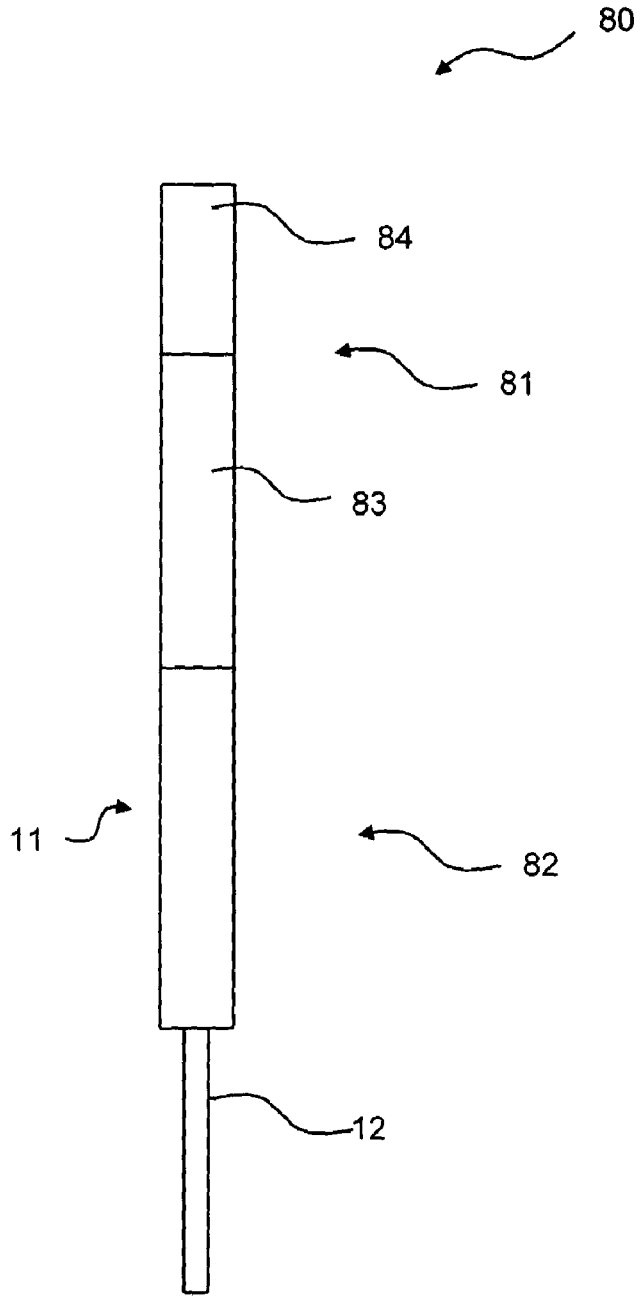
FIG. 9 is a schematic view of an evacuating system with the features of the present invention.

FIG. 9 shows an evacuating system 80 with the features of the present invention. As can be inferred from the figure, the evacuating system 80 has a hand pump (evacuation suction/vacuum source) 81 and a suction lance 82. In terms of design, the suction lance 82 corresponds to the suction lance 10 of FIG. 1. Identical elements have the same reference numbers.

The hand pump 81 is detachably mounted onto the upper end of the housing 111 of the suction lance 82 and has a pumping section 83 and a handle 84. By removing the handle 84 from the pumping section 83, a piston valve is removed, in the known manner, from the pumping section 83 by means of a connecting rod, as a result of which air is suctioned out of the suction lance 82.

A portable and power-supply-independent vacuum packing system can be made available by means of the evacuating system 80 and one of the storage container 28, 35, 59, 69 or 70. Particularly in outdoor activities, for example, fishing in the open countryside, the caught fish can be inserted into the respective storage container and then be vacuum packed by means of the evacuating system 80 by actuating the handle 84 in the respective storage container. In this way, a greatest possible shelf life of the caught fish is achieved, on the one hand. On the other hand, no flies or wild animals are attracted by the smell of the fish.

While specific embodiments of the invention have been shown and described in detail to illustrate the application of the principles of the invention, it will be understood that the invention may be embodied otherwise without departing from such principles.

APPENDIX

| LIST OF REFERENCE NUMBERS: | |
|---|---|
| 10 | Suction lance |
| 11 | Housing |
| 12 | Insertion connection piece |
| 13 | Filter chamber |
| 14 | Mount |
| 15 | Channel |
| 16 | Orifice |
| 17 | Slot |
| 18 | First housing part |
| 19 | Second housing part |
| 20 | Foam filter |
| 21 | Activated carbon filter |
| 22 | One-way valve |
| 23 | Tube section |
| 24 | Outlet |
| 25 | Opening |
| 26 | Slot |
| 27 | Opening |
| 28 | Storage container |
| 29 | Bag |
| 30 | Opening |
| 31 | Clip seal |
| 32 | Hose connection piece |
| 33 | Ribs |
| 34 | Opening |
| 35 | Storage container |
| 36 | Bag |
| 37 | Chamber |
| 38 | Chamber |
| 39 | Chamber |
| 40 | Chamber |
| 41 | Chamber |
| 42 | Chamber |
| 43 | Chamber |

APPENDIX-continued

| LIST OF REFERENCE NUMBERS: | |
|---|---|
| 44 | Web |
| 45 | Web |
| 46 | Web |
| 47 | Web |
| 48 | Web |
| 49 | Web |
| 50 | Opening |
| 51 | Opening |
| 52 | Opening |
| 53 | Opening |
| 54 | Opening |
| 55 | Opening |
| 56 | Spacer |
| 57 | Spacer |
| 58 | Spacer |
| 59 | Storage container |
| 60 | Bag |
| 61 | Opening |
| 62 | Hose connection piece |
| 63 | Clip seal |
| 64 | Clip seal |
| 65 | Weld seam |
| 66 | Opening |
| 67 | Clip seal |
| 68 | Weld seam |
| 69 | Storage container |
| 70 | Bag |
| 71 | Chamber |
| 72 | Chamber |
| 73 | Chamber |
| 74 | Chamber |
| 75 | Chamber |
| 76 | Web |
| 77 | Storage container |
| 78 | Bag |
| 79 | Web |
| 80 | Evacuating system |
| 81 | Hand pump |
| 82 | Suction lance |
| 83 | Pumping section |
| 84 | Handle |

What is claimed is:

1. A device for vacuum packing articles by evacuating the interior space of a flexible storage container, the device comprising:

a suction lance for insertion into the storage container and defining a suction means for evacuating the interior space of the storage container; and a filtering means associated with said suction lance for retaining particles, fluid or other contaminants suctioned by said suction lance, said suction lance having a structure defining a filter chamber for accommodating said filtering means, said filter chamber having a storage section for particles and fluid, said filter chamber having a reaction section arranged downstream of said storage section, said filter means comprising a foam filter and an activated carbon filter, said foam filter being disposed in said storage section and said activated carbon filter being disposed in said reaction section.

2. A device in accordance with claim 1, wherein said suction lance has an elongated insertion connection piece with a stepped orifice.

3. A device in accordance with claim 2, wherein said stepped orifice has radial slots.

4. A device in accordance with claim 1, further comprising a one-way valve associated with said suction lance for preventing a backflow of gas into said storage container.

5. A device in accordance with claim 4, wherein said one-way valve is arranged between said storage section and said reaction section.

6. A device in accordance with claim 1, further comprising a suction/vacuum mount for connecting a evacuation suction/vacuum source, said suction/vacuum mount including a cone-shaped expanding tube section.

7. A device in accordance with claim 1, wherein said suction lance has an elongated outlet.

8. A device in accordance with claim 7, wherein said outlet has radial slots.

9. A device in accordance with claim 1, wherein said suction lance defines a fluid trap.

10. A device in accordance with claim 9, wherein the fluid trap is detachable.

11. A device in accordance with claim 1, further comprising an evacuation suction/vacuum source comprising a hand pump.

12. A vacuum packing system storage container for a device with a suction lance for insertion into the storage container and defining suction means for evacuating the interior space of the storage container and filtering means associated with said suction lance for retaining particles, fluid or other contaminants suctioned by said suction lance, said suction lance having a structure defining a filter chamber for accommodating said filtering means, said filter chamber having a storage section for particles and fluid and a reaction section arranged downstream of said storage section, said filter means comprising a foam filter and an activated carbon filter, said foam filter being disposed in said storage section and said activated carbon filter being disposed in said reaction section, the storage container comprising:

a storage container body with a sealable opening for inserting articles to be stored into the storage container and an evacuating connection with a hose connection piece, said storage container body consisting of a laminated double layer film, wherein an inner layer consists of polyethylene (PE) and an outer layer consists of polyamide (PA).

13. A storage container in accordance with claim 12, wherein the storage container is a re-useable storage container.

14. A storage container in accordance with claim 12, wherein said hose connection piece has a plurality of ribs.

15. A storage container in accordance with claim 12, wherein said hose connection piece or said opening include a sealing means comprising one of a clip seal, a pressure seal and a zipper seal.

16. A storage container in accordance with claim 15, wherein said clip seal, pressure seal or zipper seal is laminated or welded to or adjacent to said sealable opening or said hose connection piece.

17. A storage container in accordance with claim 12, wherein said storage container body defines a plurality of chambers.

18. A storage container in accordance with claim 17, wherein said chambers are in fluid connection with one another and with said hose connection piece.

19. A storage container in accordance with claim 18, wherein said storage container body includes spacers defining a keep-clear means for providing fluid connection therethrough.

20. A storage container in accordance with claim 12, wherein the storage container is made of a synthetic resin material that is suitable for microwave radiation.

21. A vacuum packing system, comprising:

a device with a suction lance for insertion into a storage container and defining a suction means for evacuating an interior space of the storage container and a filtering means associated with said suction lance for retaining particles, fluid or other contaminants suctioned by said suction lance, said suction lance having a structure defining a filter chamber for accommodating said filtering means, said filter chamber having a storage section for particles and fluid, said filter chamber having a reaction section arranged downstream of said storage section, said filter means comprising a foam filter and an activated carbon filter, said foam filter being disposed in said storage section and said activated carbon filter being disposed in said reaction section; and a storage container with a sealable opening for inserting the articles to be stored therein, and with an evacuating connection, wherein the evacuating connection is a hose connection piece, said storage container consisting of a laminated double layer film, wherein an inner layer consists of polyethylene (PE) and an outer layer consists of polyamide (PA).

* * * * *